United States Patent [19]

Oshima et al.

[11] Patent Number: 4,949,006

[45] Date of Patent: Aug. 14, 1990

[54] SPARK PLUG STRUCTURE

[75] Inventors: Takafumi Oshima; Kazuhiko Kozuka; Shigeyasu Yamada, all of Nagoya, Japan

[73] Assignee: NGK Spark Plug Co., Inc., Nagoya, Japan

[21] Appl. No.: 369,114

[22] Filed: Jun. 21, 1989

[30] Foreign Application Priority Data

| | | | |
|---|---|---|---|
| Jun. 21, 1988 | [JP] | Japan | 63-151153 |
| Jul. 15, 1988 | [JP] | Japan | 63-174954 |
| Jul. 18, 1988 | [JP] | Japan | 63-178661 |
| Jan. 6, 1989 | [JP] | Japan | 64-1857 |
| Jan. 9, 1989 | [JP] | Japan | 64-1300 |

[51] Int. Cl.[5] ..... H01T 13/20; H01T 13/38

[52] U.S. Cl. ..... 313/144; 313/137

[58] Field of Search ..... 313/136, 137, 141, 144

[56] References Cited

U.S. PATENT DOCUMENTS

| | | | |
|---|---|---|---|
| 1,169,203 | 1/1916 | Sprung . | |
| 1,344,954 | 6/1920 | Meyer | 313/136 |
| 1,345,765 | 7/1920 | Hadrich | 313/137 X |
| 2,053,369 | 9/1936 | Jeffery et al. | 123/169 |
| 2,301,686 | 11/1942 | Doran | 123/169 |
| 2,863,080 | 12/1958 | Bychinsky et al. | 313/137 |
| 3,295,005 | 12/1966 | Poellet et al. | 313/137 |

FOREIGN PATENT DOCUMENTS

| | | |
|---|---|---|
| 55-46634 | 11/1980 | Japan . |
| 382770 | 11/1932 | United Kingdom . |

*Primary Examiner*—Sandra L. O'Shea

*Attorney, Agent, or Firm*—Cooper & Dunham

[57] ABSTRACT

A spark plug structure comprising; a cylindrical metallic shell; a joint type insulator having a center bore, and including a front half piece and a rear half piece, each made of a tubular aluminum nitride (AlN), and the front and rear half pieces being joined at their respective end by means of a glass sealant, and encased into the metallic shell; a center electrode placed into the center bore of the insulator; an elongated terminal placed into the rear half piece of the insulator; an electrically conductive glass provided to seal respective spaces appeared between the center electrode, insulator and the terminal; the front half piece having an elongated projection, the length of which is more than 2.0 mm, and the rear half piece having a recess the depth of which is more than 2.0 mm, the front and rear half pieces being jointed at the projection and the recess by means of an annular glass sealant which has thickness of less than 2.0 mm and length of more than 2.0 mm.

7 Claims, 6 Drawing Sheets

SPARK PLUG STRUCTURE

BACKGROUND OF THE INVENTION

1. Field of the Invention

The invention relates to a spark plug structure in use for internal combustion engine in which an insulator includes rear and front half pieces which join at their respective ends, and particularly concerns to a spark plug structure in which the front half piece is made from aluminum nitride of good thermal conductivity.

2. Description of Prior Art

In a spark plug generally used for internal combustion engine, and insulator of the spark plug has been mainly made of alumina ($Al_2O_3$). Due to low thermal conductivity of alumina, the insulator is unable to release sufficient quantity of heat in a combustion chamber when applied to high efficient engine of these days. The heat-laden insulator causes unfavorable preignition According to Japanese Patent Publication No. 55-46634, it is suggested that the insulator is made from aluminum nitride (AlN) of good thermal conductivity so as to release the heat in a combustion chamber.

In order to save cost, it is proposed that the insulator is divided into two pieces of rear and front half pieces. The front half piece is made from aluminum nitride (AlN) of good thermal conductivity, and the rear half piece is made from alumina ($Al_2O_3$). Two pieces are joined at their respective ends by means of glass sealant.

Due to relatively poor strength at the joined portions, there holds risk of cracks occurring on the glass sealant so as to loosen the jointed portions at the time of providing the glass sealant.

Further, cracks may occur on the insulator at the time of caulking a metallic shell which encases the insulator.

Therefore, it is an object of this invention to provide a spark plug structure which is capable of avoiding cracks from occurring on an insulator at the time of providing glass sealant, and at the time of caulking a metallic shell.

It is another object of this invention to provide a spark plug structure which has improved insulator to prevent preignition, and thermal shock from occurring even when applied to high efficient engine in which the insulator is exposed to rapid cooling and heating cycle with huge difference of temperature and pressure.

It is further object of this invention to provide a spark plug structure which is capable of contributing to cost-saving, high yield and mass production.

According to the present invention, there is provided a spark plug structure comprising; a cylindrical metallic shell having a ground electrode; a joint type insulator having a center bore, and including a front half piece and a rear half piece, each made of a tubular aluminum nitride (AlN), and the front and rear half pieces being joined at their respective end by means of a glass sealant, and concentrically encased into the metallic shell; a center electrode concentrically placed into the center bore of the insulator with a front end of the electrode somewhat extended outside that of the insulator to form a spark gap with the ground electrode; an elongated terminal placed into the rear half piece of the insulator with a rear end of the terminal somewhat extended outside that of the rear half piece; an electrically conductive glass provided to seal respective spaces appeared between the center electrode, the insulator and the terminal; the front half piece having an elongated projection, the length of which is more than 2.0 mm, and the rear half piece having a recess, the depth of which is more than 2.0 mm, the front and rear half pieces being jointed at the projection and the recess by means of an annular glass sealant which has thickness of less than 2.0 mm and length of more than 2.0 mm.

The annular glass sealant is determined to have thickness of less than 2.0 mm and length of more than 2.0 mm.

Enough strength is imparted to the glass sealant to sufficiently resist to a load of 200 Kg required when the glass sealant is provided.

The recess is surrounded by an annular periphery, thickness of which is determined to be more than 1.5 mm. This enables to prevent cracks from occurring on the insulator at the time of caulking the metallic shell.

Various other objects and advantages to be obtained by the present invention will appear in the following description and in the accompanying drawings.

DETAILED DESCRIPTION OF THE EMBODIMENTS

Figure 1:
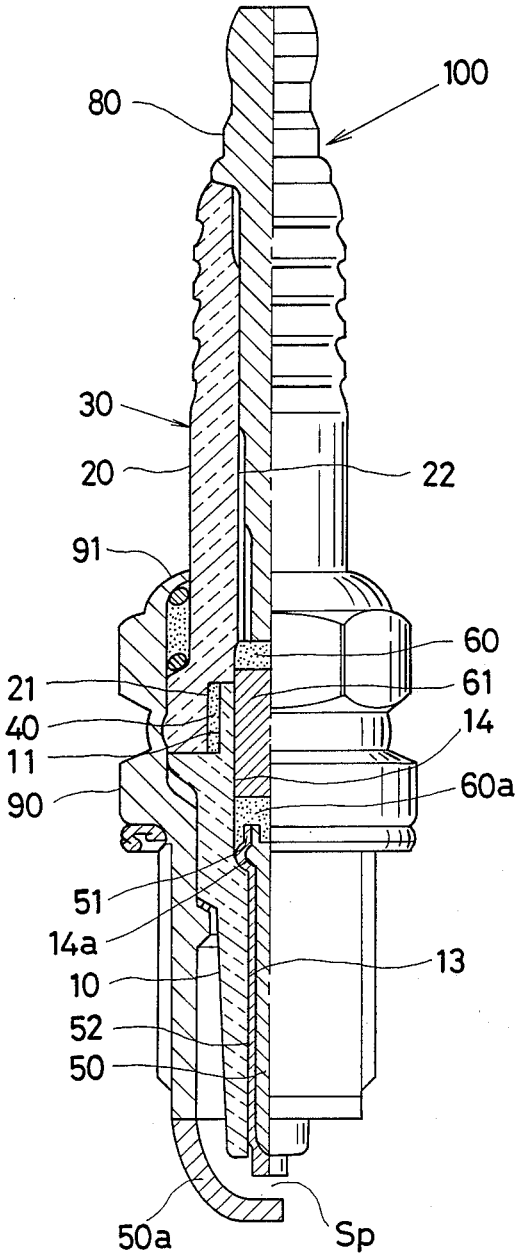
FIG. 1 is a longitudinal cross sectional view of a spark plug.
Figure 2:
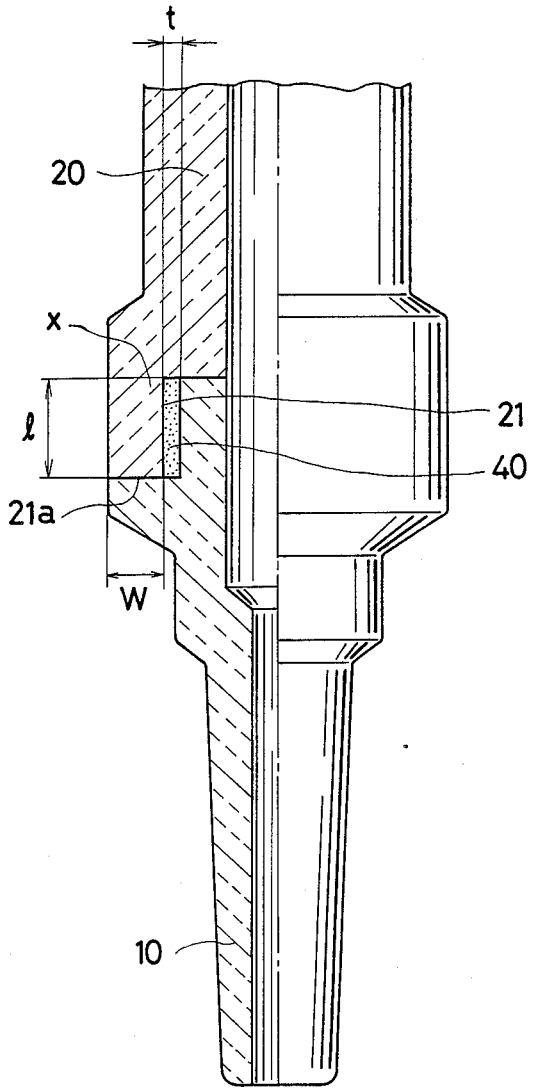
FIG. 2 is partly sectioned view of an insulator, but upper part is somewhat broken away.

Referring to FIGS. 1 and 2, a spark plug 100 according to the present invention, has a metallic shell 90 having a ground electrode 50*a* integrally. Into the metallic shell 90, a tubular insulator 30 is concentrically placed.

The insulator 30 is joint type comprising rear and front half pieces 20 and 10. The front half piece 10 is made from aluminum nitride (AlN) of high thermal conductivity, while the rear half piece 20 is made of alumina ($Al_2O_3$) for the purpose of cost-saving. The front half piece 10 has an elongated projection 11, and the rear half piece 20 has a recess 21. The rear and front half pieces 20 and 10 are joined at their recess 21 and the projection 11 by means of an annular glass sealant 40.

In the meanwhile, the recess 21 is surrounded by an annular periphery, thickness dimension (W) of which is determined to be more than 1.5 mm as described in detail hereinafter.

The common length in which the rear and front half pieces 20 and 10 are joined, corresponds to the length (l)

of the glass sealant 40. The glass sealant 40 is made from CaO, BaO, $Al_2O_3$ or $SiO_2$-based vitreous material, and determined at its length (l) and thickness (t) to be 4.0 mm and 1.0 mm respectively. It is noted that minimum limit of the length (l) is 2.0 mm, while the maximum limit of the thickness (t) is 2.0 mm to sufficiently resist the maximum load of 200 Kg applied to the glass sealant 40 when providing it.

The recess 21 is, as mentioned before, surrounded by an annular periphery, the thickness dimension (W) of which is determined to be 3.0 mm by way of illustration. The thickness dimension (W) is required at least 1.5 mm to resist to maximum load of around 5 tons applied when the metallic shell 90 is squelched of an annular end 91 by means of caulking.

On the other hand, the front half piece 10 of the insulator 30 has axial bores 13 and 14 of different diameter. The rear half piece 20 of the insulator 30 has an axial bore 22 communicated with the bores 13 and 14 so as to constitute a central bore as a whole. Into the axial bores 13 and 14, a center electrode 50 is placed with the front end somewhat extended outside from that of the front half piece 10 to form a spark gap (Sp) with the ground electrode **50*a***.

The center electrode 50 has a flanged head 51 at its rear end, and made from a copper-based core clad by a nickelbased alloy. At the time of assemble, the center electrode 50 is inserted through the rear ends of the axial bores 13, 14 and 22, and received at its flanged head 51 by a shoulder **14*a* of the diameter-increased bore 14. In this instance, the center electrode 50 may be adhered to an inner surface of the bore 13 by means of a heat-resistant adhesive 52**.

At the space in which the two bores 15 and 22 meet, a resistor 61 is placed with its upper head and bottom sandwiched by electrically conductive layers 60 and **60*a* for the purpose of noise reduction. Into the axial bore 22, an elongated terminal 80 is air-tightly inserted in a manner to sandwich the conductive layer 60 with the resistor 61**.

Figure 3:
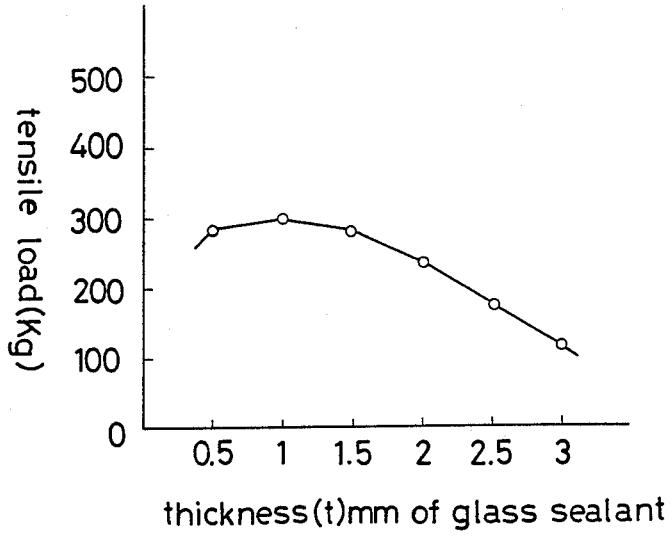
FIG. 3 is a graph showing relationship between tensile load (Kg) and thickness (t) of glass sealant.
Figure 4:
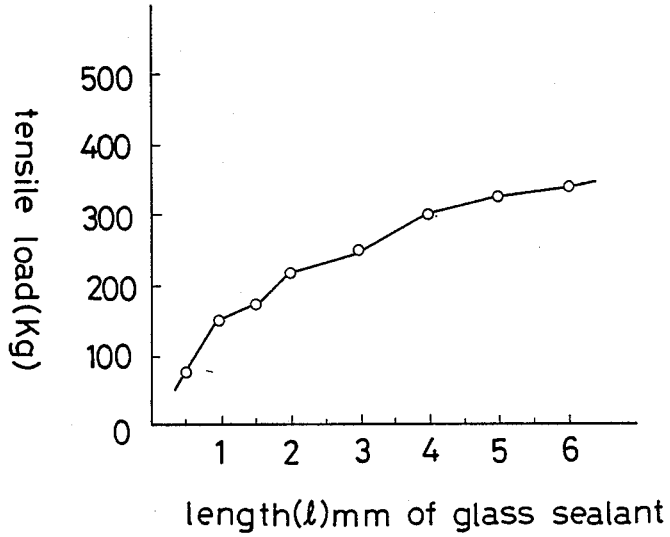
FIG. 4 is a graph showing relationship between tensile load (Kg) and length (l) of glass sealant.

Now, FIGS. 3 and 4 show the result of strength test carried out by changing the thickness (t) and length (l) of the glass sealant 40 which has joined the rear and front half pieces 20 and 10.

FIG. 3 shows the result of tensile test in which the joint type insulator 30 has undergone under the ambient temperature of around 1000 degrees Celsius depending on the thickness dimension (t) of the glass sealant 40 with the length (l) as constant 4.0 mm.

FIG. 4 shows the result of tensile test in which the joint type insulator 30 has undergone under the ambient temperature of around 1000 degrees Celsius depending on the length dimension (l) of the glass sealant 40 with the thickness dimension (t) as constant 1.0 mm.

As a result, it has found that the requirements of $l \geqq 2.0$ mm, $t \leqq 2.0$ mm are apparently obtained to resist the maximum load of 200 Kg.

Figure 5:
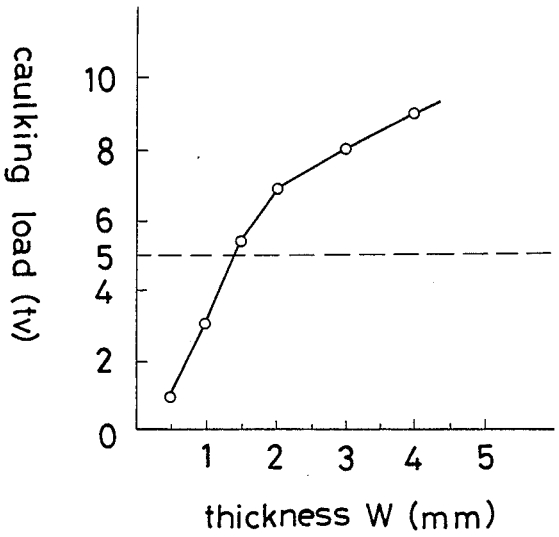
FIG. 5 is a graph showing relationship between caulking load (ton) and thickness (w)

FIG. 5 shows the result of the strength test carried out by changing the thickness dimension (W) of the annular periphery **21*a* in the recess 21**.

In this strength test, various loads are measured when the cracks occurred on the annular periphery **21*a* at the time of caulking the metallic shell 90** as designated by (x).

As the result of this test, it has found that it is necessary to arrange as $W \geqq 1.5$ mm to cope with the maximum load of around 5 tons.

As understood from the foregoing description, it is necessary to arrange dimensions (t), (l) and (W) as follows:

That is, $t \leqq 2.0$ mm, $l \geqq 2.0$ mm and $W \geqq 1.5$ mm.

These dimensional arrangement enables to prevent cracks from occurring on the joint type insulator 30.

As a modified form of this invention, the front half piece 10 is made of sintered aluminum nitride (AlN) of more than 60 w/mk in thermal conductivity. On an outer surface of the front half piece 10, a non-crystallized alumina layer of 1–30 microns is coated by means of CVD or the like. The rear and front half pieces 20 and 10 are bonded by a vitreous adhesive of high melting point.

The front half piece 10 is coated with fine-structured alumina, so that the alumina layer is prevented from transforming into Trigonal corundum by oxidation, at the same time, prevented from being separated, thus contributing to long service life.

EXAMPLE 1

The alumina ($Al_2O_3$) layer is made by previously oxidizing the aluminum nitride piece 10 of 20 mm in length. The experiment is carried out under 5500 rpm X 4/4 of six-cylinder engine with displacement of 2000 cc for 100 hours.

After the experiment, oxidation degree is measured by EPMA, it is found from Table 1 that the thicker the alumina layer is, the lesser the formation of $Al_2O_3$ is as seen from sample A to sample E. The alumina layer of 1 micron is sufficient to protect the aluminum nitride from being oxidized into $Al_2O_3$ more than necessary. However, the upper limit of the thickness of the alumina layer is around 30 microns, because too much alumina causes to separation.

TABLE 1

| | previous oxidation | thickness of $Al_2O_3$ | thickness of $Al_2O_3$ after 100 hours |
|---|---|---|---|
| sample A | no oxidation | 0 μm | 40 μm |
| sample B | oxidation | 0.8 μm | 35 μm |
| sample C | oxidation | 1 μm | 25 μm |
| sample D | oxidation | 3 μm | 20 μm |
| sample E | oxidation | 10 μm | 18 μm |

EXAMPLE 2

The samples A to E as used in the experiment 1, are undergone the anti-preignition test under four-cylinder engine with displacement of 1600 cc. As seen in Table 2, the thickness of $Al_2O_3$ substantially has no affect on the anti-preignition. The samples C, D and A have figures similar to those of sample F which has no layer of $Al_2O_3$, and representing high heat-resistant characteristics compared to the prior and BPR6EY plug.

Now, various kinds of Vitreous materials is listed in Table 3 to be applied to the annular glass sealant 40. These vitreous materials are of high melting point of more than 500 degrees Celsius, and of 32–80 X $10^{-1}$ in thermal expansion which falls between that of AlN and that of $Al_2O_3$.

TABLE 2

| | length exposed to combustion chamber (mm) | thickness of $Al_2O_3$ | ignition timing (BTDC) 25 | 30 | 35 | 40 | 45 | 50 | 55 |
|---|---|---|---|---|---|---|---|---|---|
| sample A | 20 | 40 | | | | | | ▲▲▲ | ▲▲ |
| sample B | 20 | 35 | | | | | | ▲▲ | ▲▲▲ |
| sample C | 20 | 25 | | | | | | ▲ | ▲▲▲▲ |
| sample D | 20 | 20 | | | | | | | ▲▲▲▲ ▲ |
| sample E | 20 | 18 | | | | | | | ▲▲▲▲ ▲ |
| sample F | 20 | 0 | | | | | | | ▲▲ ▲▲▲ |
| $Al_2O_3$ BPR4EY | 20 | — | ▲ | ▲▲▲ | | | | | |
| $Al_2O_3$ BPR6EY | 14 | — | | | | | ▲▲ | ▲▲▲ | |

TABLE 3

| vitreous material | thermal expansion ($\times 10^{-7}$/°C.) | melting point (°C.) | sintered temp. (°C.) | volume resistance Log$\rho$($\Omega$.m) at 150° C. |
|---|---|---|---|---|
| $Na_2O_3.B_2O_3.SiO_2$-based glass I | 75.5 | 697 | 990 | 11.2 |
| $Na_2O_3.B_2O_3.SiO_2$-based glass II | 57.0 | 705 | 1050 | 11.4 |
| $Na_2O_3.B_2O_3.SiO_2$-based glass III | 45.5 | 698 | 1050 | 11.5 |

EXAMPLE 3

Figure 6:
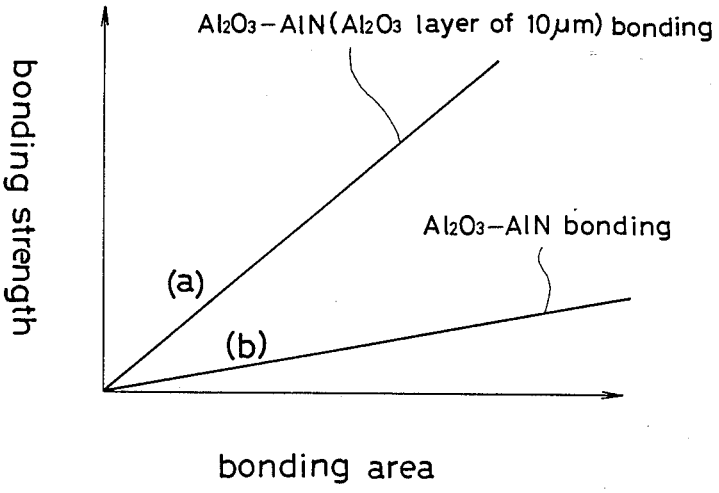
FIG. 6 is a graph showing a relationship between bonding area and bonding strength according to modified form of the invention.

FIG. 6 of (a), (b) shows that $Al_2O_3$-coated (layed of 10 um) front half piece 10 is stronger than non $Al_2O_3$-coated front half piece when bonding strength between the rear and front half pieces 20 and 10 is compared. As seen in FIG. 6 of (a), the bonding strength rapidly increases with the increase of the bonding area compared to that of (b).

As further modified form of the present invention, the annular glass sealant 40 is made of vitreous material which has a melting point of more than 500 degrees Celsius, and has a temperature of 800–1400 degrees Celsius required when the sealant 40 is provided. The thermal expansion of the vitreous material falls within the range from 32 X $10^{-7}$ to 80 X $10^{-7}$.

Maximum temperature which causes from the combustion chamber of the engine, corresponds to the temperature in which preignition occurs. At this time, the glass sealant rises its temperature as high as around 500 degrees Celsius.

Accordingly, it is required for the glass sealant 40 to have a melting point of more than 500 degrees Celsius so as to properly function. A glass use for resistor has a melting temperature of 800–1000 degrees Celsius that the glass sealant 40 is desired to have a temperature of more than 800–1000 degrees Celsius which is required at the time of providing it. But, the temperature is preferably below 1400 degrees Celsius so as not to facilitate oxidation toward the aluminum nitride (AlN). The thermal expansion of the aluminum nitride (AlN) is 32–48 X $10^{-7}$/°C., while that of alumina ($Al_2O_3$) is 69–80 X $10^{-7}$/°C. Therefore, it is necessary that the thermal expansion of the glass sealant 40 falls on the range between 32–48 X $10^{-7}$/°C. and 69–80 X $10^{-7}$/°C. to prevent cracks from occurring on the glass sealant 40. A power supply is normally 40 KV, so that it is necessary for the glass sealant 40 to have enough length (l) to withstand 40 KV at the temperature of 500 degrees Celsius. Vitreous examples which meet those requirements are shown at Table 4.

TABLE 4

| vitreous material | yield point (°C.) | thermal expansion ($10^{-7}$/°C.) | withstand voltage at 500° C. (KV/mm) |
|---|---|---|---|
| $B_2O_3$ $SiO_2$-based glass A | 550 | 45 | 18.0 |
| $B_2O_3$ $SiO_2$-based glass B | 715 | 67 | 22.5 |
| BaO-based glass A | 670 | 67 | 22.0 |
| BaO-based glass B | 710 | 68.5 | 23.5 |

Figure 7:
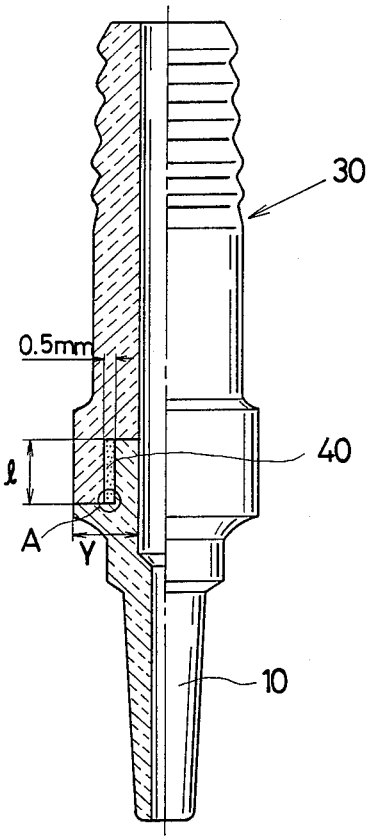
FIG. 7 is a view similar to FIG. 2 according to another modified form of the invention.
Figure 8:
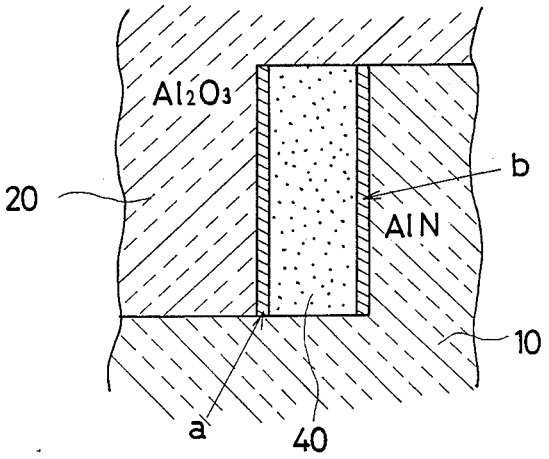
FIG. 8 is an enlarged view of a specified section of FIG. 7.

The temperature of specified portion (A) of FIG. 7 in the glass sealant 40 is measured with the use of spark plugs each corresponding to BPR4EY and BPR7EY. The engine used in this experiment is four series-cylinder, DOHC four-valve with the displacement of 1600 cc under the condition of 6000 rpm X 4/4. The ignition timing is represented by advance angles which is needed to cause preignition. The result is shown at Table 5 which teaches that the temperature of the glass sealant 40 reaches up to 500 degrees Celsius. From this result, it is apparently necessary to use vitreous material having a melting point of more than 500 degrees Celsius so as to ensure strength and electrical conditions of the glass sealant 40.

TABLE 5

| spark plug | ignition timing BTDC | temperature at (A) |
|---|---|---|
| BPR4EY | 30° | 485° C. |
| BPR7EY | 57.5° | 460° C. |

An insulator is made by using materials as listed at Table 6. The insulator is applied to a spark plug corresponding to BPR4ES with the thermal expansion of the glass sealant varying as Table 7. The engine used in this experiment is water-cooling type of six series- cylinder, OHC with the displacement of 2000 cc under operating condition of 6000 rpm X 4/4 (one minute) and idling (one minute) for 200 hours. In this experiment, six test pieces are used at each case. The result of Table 7 shows that the thermal expansion of the glass sealant 40 is needed to fall between that of the aluminum nitride and that of alumina.

TABLE 6

| material | thermal expansion ($10^{-7}$/°C.) |
|---|---|
| AlN | 34 |
| $Al_2O_3$ | 80 |

TABLE 7

| vitreous material (yield point) | thermal expansion ($10^{-7}$/°C.) | result |
|---|---|---|
| C (600° C.) | 24 | two out of six . . . cracks at (a) |
| D (550° C.) | 45 | all (6/6) . . . no cracks |
| E (595° C.) | 95 | five out of six . . . cracks at (b) |

Then, relationship between withstand voltage (KV/mm) and the length (l) of the glass sealant is checked in regard to the vitreous materials listed at Table 4. The experiment is carried out with the use of a spark plug corresponding to BPR4ES.

In this experiment, voltage of 40 KV is applied to the section designated at (Y) of FIG. 7 under the ambient temperature of 500 degrees Celsius to check whether the glass sealant 40 is perforated or not. The result is shown at Table 8 in which it is represented by crisscross when the glass sealant 40 is perforated, while it is represented by circle when the glass sealant is not perforated.

It is noted that the withstand voltage is simply expressed by the product of insulation withstand voltage and the length (l).

TABLE 8

| vitreous material | withstand voltage (KV/mm) | l: length (mm) 0.5 | 1.0 | 1.5 | 2.0 | 2.5 | 3.0 |
|---|---|---|---|---|---|---|---|
| $B_2O_3$, $SiO_2$-based glass A | 18.0 | X | X | X | O | O | O |
| $B_2O_3$, $SiO_2$-based glass B | 22.5 | X | X | X | O | O | O |
| BaO-based glass A | 22.0 | X | X | X | O | O | O |
| BaO-based glass B | 23.5 | X | X | X | O | O | O |

Figure 9:
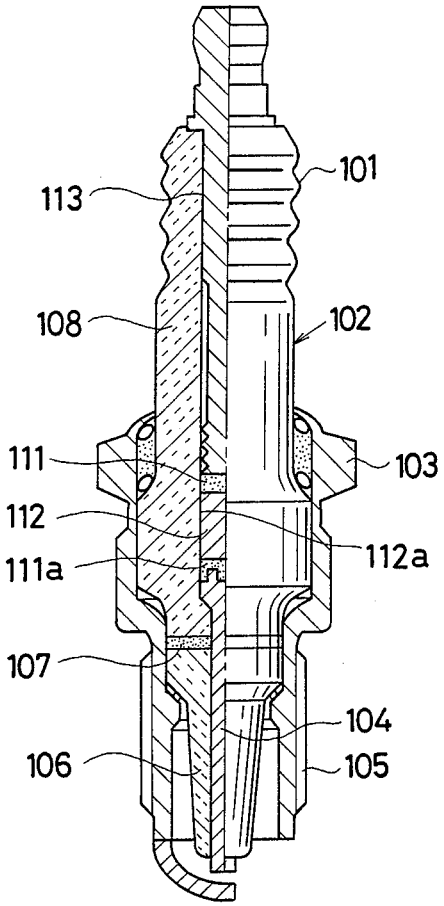
FIG. 9 is a view similar to FIG. 1 according to another embodiment of the invention.
Figure 10:
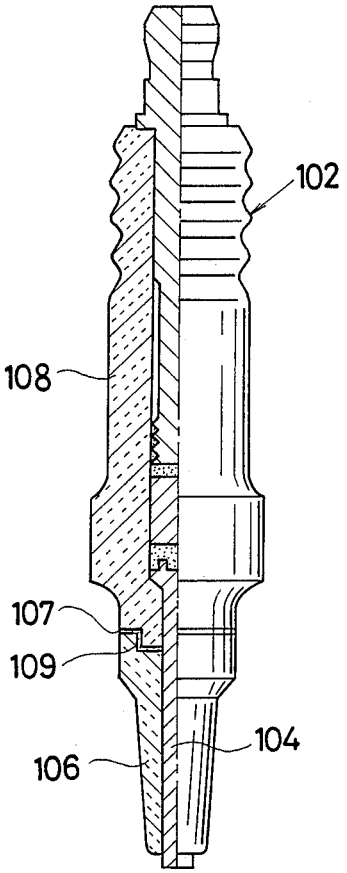
FIG. 10 is a view similar to FIG. 2 according to another embodiment of the invention.
Figure 11:
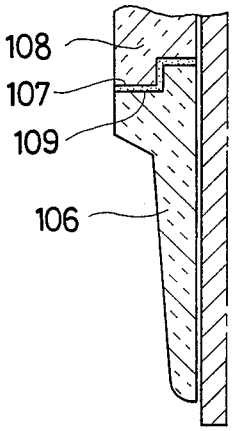
FIG. 11 is a view similar to FIG. 8 according to modified form of the invention.

Now, FIGS. 9 through 11 shows another embodiment of the invention.

A spark plug 101 comprising a center electrode 104, a tubular insulator 102, a metallic shell 103 and a spiral thread 105 cut at an outer surface of the metallic shell 103. The insulator 102 is joint type including rear and front half pieces 108 and 106. The front half piece 106 is made form ceramic material of good thermal conductivity such as beryllium oxide (BeO) and aluminum nitride (AlN), each of which has transparent property. The rear half piece 108 is made of alumina ($Al_2O_3$) on the other hand.

Such is the structure of the front half piece 106 that the front half piece 106 permit to release the heat so as to prevent preignition even when the piece 106 is exposed to high temperature gas in combustion chamber.

Expensive material of aluminum nitride (AlN) is used for the front half piece 106, thus contributing cost-saving as a whole. The rear and front half pieces 108 and 106 are bonded at 107 by means of oxidation soldering, alumina cement or glass sealant. At the portion 107, the length of projection 109 falls within the range from 0.5 mm to 8.0 mm to ensure high voltage insulation, and ready manufacturing as seen FIGS. 10 and 11.

When the thermal expansion of the front half piece 106 is greater than that of the rear half piece 108, the two pieces 106 and 108 are joined as shown in FIG. 10. When the thermal expansion of the front half piece 106 is smaller than that of the rear half piece 108, the two pieces 106 and 108 are joined as shown in FIG. 11.

It is noted that a resistor 112 is placed at a center bore **112*a* of the rear half piece 108 with the resistor 112 sandwiched between a terminal 113 and a center electrode 104 by way of an electrically conductive glass 111 and 111*a***.

It will be understand that various changes and modifications may be made in the above described structures which provide the characteristics of this invention without departing from the spirit thereof.

What is claimed is:

1. A spark plug structure comprising;

a cylindrical metallic shell having a ground electrode integrally;

a joint type insulator having a center bore, and including a front half piece and a rear half piece, and the front and rear half pieces being joined at their respective end by means of a glass sealant, and concentrically encased into the metallic shell;

a center electrode concentrically placed into the center bore of the insulator with a front end of the electrode somewhat extended outside that of the insulator to form a spark gap with the ground electrode;

an elongated terminal placed into the rear half piece of the insulator with a rear end of the terminal somewhat extended outside that of the rear half piece;

an electrically conductive glass provided to seal respective spaces appeared between the center electrode, the insulator and the terminal;

the front half piece having an elongated projection, the length of which is more than 2.0 mm, and the rear half piece having a recess, the depth of which is more than 2.0 mm, the front and rear half pieces being jointed at the projection and the recess by means of an annular glass sealant which has thickness of less than 2.0 mm and length of more than 2.0 mm.

2. In a spark plug structure as recited in claim 1, the recess is surrounded by an annular periphery, thickness of which is more than 1.5 mm.

3. In a spark plug structure as recited in claim 1, the glass sealant has a melting point of more than 500 degrees Celsius, and thermal expansion ranging from 32 X $10^{-7}$/°C. to 82 X $10^{-7}$/°C., and sealing point ranging from 800° C.–1400° C.

4. In a spark plug structure as recited in claim 1, the rear half piece of the insulator is made of alumina, and the front half piece of the insulator is made of transparent ceramic material selected from the group of transparent alumina, alumina nitride, beryllium oxide.

5. In a spark plug structure as recited in claim 1, the front half piece of the insulator is made of sintered aluminum nitride having thermal conductivity of more than 60 w/mk, and outer surface of the front half piece is coated with non-crystallized aluminum layer of 1–30 microns in thickness.

6. In a spark plug structure as recited in claim 1, the center electrode is made of a copper-based core clad by a nickel-based alloy.

7. In a spark plug structure as recited in claim 1, the front half piece of the insulator is determined to extend about 20 mm from an front end of the metallic shell.

* * * * *